United States Patent [19]

Spedale

[11] 4,072,839

[45] Feb. 7, 1978

[54] SLIDE SWITCH TYPE ASSEMBLY HAVING TWO PART HOUSING

[75] Inventor: Joseph J. Spedale, Chicago, Ill.

[73] Assignee: Chicago Switch, Inc., Chicago, Ill.

[21] Appl. No.: 695,936

[22] Filed: June 14, 1976

[51] Int. Cl.[2] ..... H01H 9/00; H01H 21/04

[52] U.S. Cl. ..... 200/295; 200/16 R; 200/67 R; 200/68; 200/67 G; 200/284; 200/293; 200/303

[58] Field of Search ..... 200/16 R, 16 C, 16 D, 200/16 F, 159 R, 284–286, 293, 294, 295, 340, 67 A, 67 PR, 67 G, 68, 303, 67 R

[56] References Cited

U.S. PATENT DOCUMENTS

| | | | |
|---|---|---|---|
| 3,072,757 | 1/1963 | Gluck | 200/16 D |
| 3,694,590 | 9/1972 | Otterlei | 200/16 C |
| 3,740,500 | 6/1973 | Garrett et al. | 200/16 C X |
| 3,757,060 | 9/1973 | Ianuzzi et al. | 200/16 C |
| 3,783,204 | 1/1974 | Kennedy et al. | 200/16 D X |
| 3,805,005 | 4/1974 | Wilkinson et al. | 200/284 |
| 3,868,486 | 2/1975 | Nakaya | 200/293 X |

*Primary Examiner*—James R. Scott
*Attorney, Agent, or Firm*—McDougall, Hersh & Scott

[57] ABSTRACT

A slide switch having opposed contacts mounted on a base with a slider assembly moving over the base. A bridging conductor is included in the assembly whereby the positioning of the slider assembly determines the relationship of the bridging conductor to the opposed contacts to thereby provide the switching characteristic. The bridging conductor is held in assembly with the slider preferably by means of a resilient element pressing the conductor or a support therefor against a slider ledge so that this assembly remains intact when separated from the base. The base contacts comprise body portions receivable in slots defined by the base, the body portions defining recesses whereby the contacts can be press fit into engagement with the base.

14 Claims, 11 Drawing Figures

FIG. 1
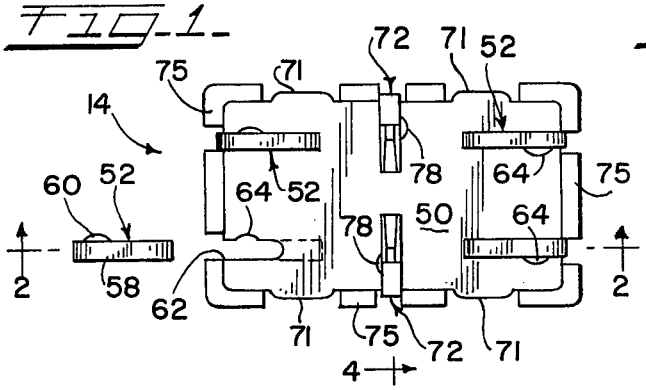
FIG. 3
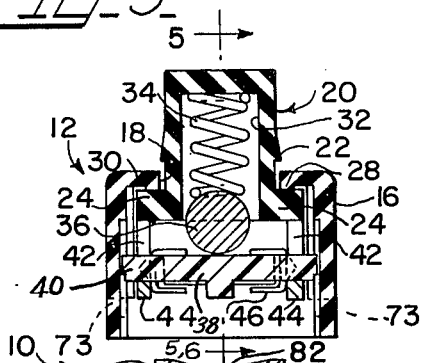
FIG. 4
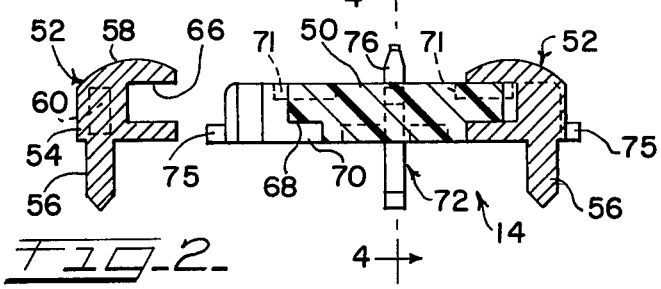
FIG. 2
FIG. 5
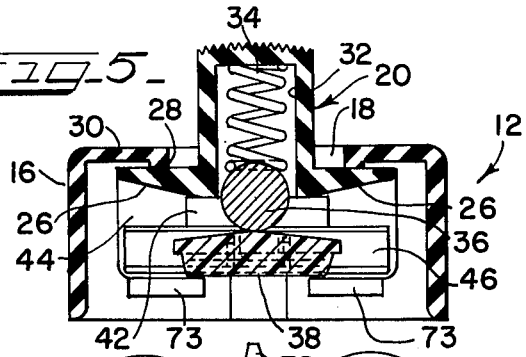
FIG. 7
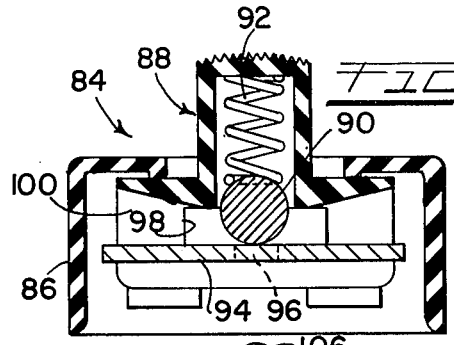
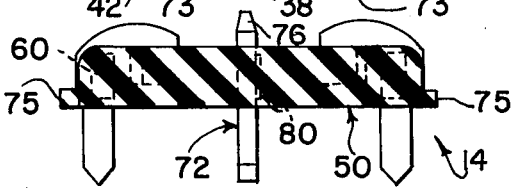
FIG. 6
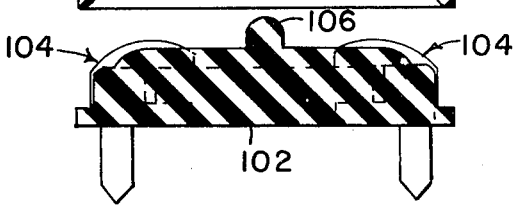
FIG. 8
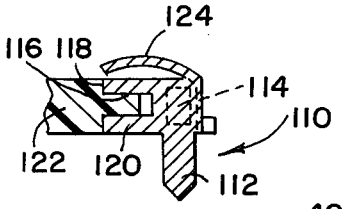
FIG. 11
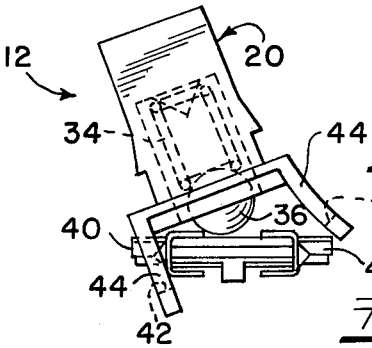
FIG. 9
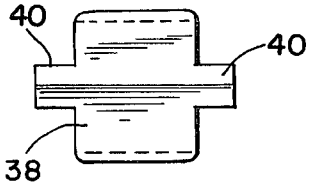
FIG. 10

SLIDE SWITCH TYPE ASSEMBLY HAVING TWO PART HOUSING

BACKGROUND OF THE INVENTION

This invention relates to a slide switch construction. The invention is particularly concerned with a slide switch construction which is characterized by a mechanical design such that the construction is ideally suited for efficient assembly, installation and use.

Slide switch constructions are often manufactured in very small sizes whereby it becomes difficult to manufacture and install the switches. The components making up such switches are often so small that manual assembly requires significant dexterity, and this leads to increased manufacturing costs. The size of the switches also presents problems during installation.

Installation problems are also encountered due to the fact that the terminals formed in such switches are normally soldered to lead wires and the like when the switches are included in a circuit. Such operations result in the creation of contamination which can seriously affect the switch operating characteristics. For example, the heat generated may lead to oxidation or other contamination of contact surfaces thereby affecting the electrical characteristics of such contacts. In addition, vapors produced during soldering may lead to deposits on contact surfaces which undesirably affects the electrical characteristics.

Chemical cleaning has been attempted in some instances for purposes of avoiding contamination; however, in order to expose the contact surfaces for cleaning purposes after a soldering operation, the final assembly of the switch must be delayed until completion of the soldering operation. This creates problems for installers who are not familiar with the often complex assembly operations required, particularly in the case of small switches.

It is a general object of this invention to provide a switch construction which is characterized by a design which greatly facilitates assembly and installation of the switch.

It is a further object of this invention to provide a switch contact construction which is particularly useful for purposes of increasing switch assembly efficiencies and reliability of operation.

It is a more specific object of this invention to provide a switch construction of the type described which can be easily installed in an operation including a soldering operation while permitting cleaning of the switch contacts so that contaminated contacts can be avoided.

BRIEF DESCRIPTION OF THE DRAWINGS

These and other objects of this invention will appear hereinafter, and for purposes of illustration, but not of limitation, specific embodiments of the invention are shown in the accompanying drawings in which:

FIG. 1 is a plan view of the base of a switch construction characterized by the features of this invention;

FIG. 2 is a cross-sectional view taken about the line 2—2 of FIG. 1;

FIG. 3 is a vertical sectional view of the slider assembly portion of the switch construction;

FIG. 4 is a vertical sectional view taken about the line 4—4 of FIG. 2;

FIG. 5 is a cross-sectional view of the slider assembly taken about the line 5—5 of FIG. 3;

FIG. 6 is a cross-sectional view of the base taken about the line 6—6 of FIG. 4;

FIG. 7 is a cross-sectional view of a modified form of slider assembly;

FIG. 8 is a cross-sectional view of a modified base;

FIG. 9 is an elevational view illustrating the slider assembly of FIG. 3 in an intermediate stage of assembly;

FIG. 10 is a plan view of the rocker element utilized in the slider assembly of FIG. 3; and, FIG. 11 is a fragmentary sectional view illustrating an alternative form of the invention.

DESCRIPTION OF THE PREFERRED EMBODIMENTS

This invention generally relates to a switch construction of the type including opposed contacts positioned on a base. A slider assembly is movable over the base, the assembly including a slider with an associated bridging conductor. Sliding movement of this assembly shifts the bridging conductor between a first position whereat the conductor will complete a circuit between two contacts. At least one other position characterizes the switch operation, and this could be an open switch position, but more often involves completion of a separate circuit. Typically, a center contact will be common to the respective circuits, and the bridging conductor will be characterized by a rocking movement during shifting between respective switch positions.

The construction of the invention is particularly characterized by a slider assembly which includes means for associating the bridging conductor and the slider in a secure relationship whereby the slider assembly will be intact whether or not the assembly is attached to the switch base. In the preferred form of the invention, ledge means are utilized for supporting the bridging conductor, and resilient means normally press the conductor or a support for the conductor against the ledge means. This arrangement keeps the assembly intact when the assembly is separated from the switch base.

The switch base includes one, and preferably up to six, contacts which are designed for secure attachment to the base. At the same time, the contacts and the base are characterized by a very straightforward design so that these elements can be efficiently manufactured and readily assembled.

More specifically, the base of the switch construction defines slots in the desired contact locations. The slot walls define at least one recess, and contacts defining a corresponding protrusion are adapted to be pressed into the slots with the protrusions and recesses serving to lock the contacts in place. The base material may be of any standard insulating composition which is sufficiently resilient so that the thickness of the contacts will correspond with the slot widths enabling a secure and simple press fitting assembly operation.

The switch constructions illustrated in the accompanying drawings are characterized by the features described above. FIGS. 1 through 6, 9 and 10 illustrate a switch construction 10 comprising a top assembly 12 and a base assembly 14. The top assembly is particularly illustrated in FIGS. 3 and 5, and it comprises an enclosure 16 defining an opening 18 in its top wall. A slider 20 is associated with the enclosure with the upper portion of the slider being exposed through the opening 18 whereby the slider can be moved back and forth manually relative to the enclosure.

The side walls of the slider define nibs 22 whereby the slider can be snapped into position by pressing the slider upwardly through the opening 18. The slider and enclosure are formed of a suitable plastic material whereby resilient characteristics are provided for purposes of achieving such fitting assembly operations.

The slider defines shoulder portions 24 along its sides, and longer shoulders 26 extending from each end whereby upper slider surfaces are provided for bearing against the rectangular ridge 28 defined on the underside of the top wall 30 of the enclosure. In addition, the slider defines an open interior portion 32 for receiving spring 34. A ball 36 is positioned partially within the interior portion for engagement with the bottom end of the spring 34.

The ball 36 is pressed by means of the spring 34 against the top surface of rocker 38, this rocker also being formed of a suitable plastic insulating material. The rocker 38 is also illustrated in FIGS. 9 and 10, and it will be noted that wing portions 40 are formed on each side of the rocker. These wing portions are received within openings 42 defined by the downwardly depending walls 44 of the slider 20.

The rocker 38 carries a pair of channel-shaped bridging contactors 46. These bridging contactors each define punched-out central openings whereby the contactors will fit over the wings 40 of the rocker 38. The punching operation should provide a contactor opening large enough relative to the width of the wings 40 whereby the bridging contactors will have freedom of movement relative to the rocker 38.

As best illustrated in FIG. 9, assembly of the top assembly 12 first involves assembly of the rocker and bridging contactors independently of the assembly of the spring and ball with the enclosure 20. The enclosure is then assembled with the rocker in the manner illustrated by inserting one wing 40 in the opening 42 of one wall 44, and then forcing the other wall 44 over the other wing 40 whereby this wing will snap into the other opening 42. The top assembly 12 is then completed by pressing the assembly of FIG. 9 into the enclosure 16 in the manner described. It will be appreciated that this results in an assembly which is self-sustaining since the spring 34 will continually press the rocker 38 into engagement with the bottom edge of the openings 42, these bottom edges defining ledges for supporting the wings 40 of the rocker.

The enclosure 16 defines vertical grooves 65 in its side walls, and the ends 67 of wings 40 are received in these grooves. This prevents any appreciable lengthwise movement of the rocker, it being understood that the widths of grooves 65 are such that pivoting movement of the rocker is not restrained.

The base assembly 14 comprises base 50 in combination with a plurality of terminal elements which have integrally formed contact surfaces. As best shown in FIGS. 1 and 2, these terminal elements include elements 52 which comprise a body portion 54 and terminal portions 56, the latter in this illustration being designed for insertion in a printed circuit board. It will be appreciated that the terminals could define lugs for attachment of leads for use other than in association with printed circuit boards.

The upper curved surfaces 58 of the terminal elements serve as the contact portions of the terminal elements. The terminal elements 52 include protrusions 60 formed in one side wall. The base 50 defines slots 62, and recesses 64 are defined in one side wall of each slot. The elements 52 are adapted to be press fit into the slots, and the protrusions 60 in combination with the recesses 64 serve to lock the elements in place. To secure the elements against vertical displacement, they are provided with notches 66. The top surface of each notch fits against the top surface of base 50, and the bottom surface of each notch engages the upper surface 68 defined by the recessed area 70 forming an extension of each slot 62.

Center terminal elements 72 are also characterized by a design facilitating attachment to the base 50. As best shown in FIG. 4, these elements define terminal portions 74, and upwardly extending portions 76 which define contact surfaces and also serve as fulcrum means in the switch operation. The base defines slots of essentially the design of the slots 62, and these slots include recesses 78. Protrusions 80 defined by the terminal elements 72 provide for locking of these elements into position on the base 50. Notches 82 defined by the elements 72 serve to prevent vertical displacement of the elements in the same manner as described with reference to notches 66.

The base 50 defines a pair of locking tabs 71 on each side. Locking tab windows 73 are in turn defined by the enclosure 30. The top assembly and base assembly are interconnected by pressing the two together so that the tabs 71 will be received within the windows 73. Flange elements 75 are formed integrally with the base 50, and the positions of the tabs 71 and windows 73 are such that the bottom edge of the enclosure 30 will be located against the flanges 75 when the top and base assemblies are interconnected.

FIGS. 7 and 8 illustrate a somewhat modified form of the invention. The construction illustrated includes a top assembly 84 comprising an enclosure 86 and a slider 88 of the design previously described. In this instance, the ball 90 is urged downwardly by means of spring 92 into engagement with a bridging contactor 94. This contactor includes wing portions 96 which are received within the opening 98 defined by the oppositely positioned downwardly extending walls 100 of the slider. The bottom edges of the respective openings 98 provide ledges for supporting the contactor in the same manner as described with respect to the rocker 38. It will be appreciated that this provides a self-sustaining top assembly.

The base 102 is provided with slots for receiving terminal elements 104 which are of the same design as the terminal elements 52. Instead of a central terminal as previously described, the base 102 defines an integrally formed ridge 106 which provides a fulcrum for the bridging contactor 94 when the switch is assembled. The assembly mechanism may be as described with reference to the switch 10.

FIG. 11 illustrates a terminal element 110 which comprises an alternative design. In this instance, the element includes a terminal portion 112 and a protrusion 114 which functions in a manner corresponding with the protrusion 60 of a terminal element 52. In addition, a notch 116 is defined by means of upper and lower fingers 118 and 120 so that vertical displacement of the terminal element is prevented. This is accomplished since the base defines a portion 122 defined for receipt of the fingers 118 and 120.

The contact portion of the terminal element is provided by means of a spring finger 124. It will be noted that the front end of this spring finger is spaced away from the finger 118 so that a degree of movement of the spring finger is provided. In accordance with typical switch design, a bridging contact brought into contact with the spring finger will be forced thereagainst whereby the spring characteristics of the finger will insure a positive contact. Thus, with the arrangement of FIG. 11, the spring pressure can be provided by the terminal element instead of being provided by the mechanisms supporting the bridging contact. It will be appreciated, however, that spring characteristics could be associated with the bridging contact as well as with a terminal element of the type illustrated in FIG. 11.

As previously indicated, the concepts of this invention provide for the use of a subassembly which remains intact when out of association with the base portion of the construction. In the embodiments illustrated, a spring 34 or 92 is utilized for achieving the intact character of the subassembly. Where a spring mechanism as illustrated in FIG. 11 is employed, however, other means may be utilized for holding the subassembly intact. For example, the assembly including the bridging contactors could be held in association with ledges 73 by magnetic means or some other mechanical arrangement not involving use of a spring. It will also be appreciated that with a contact such as shown in FIG. 11, the bridging contactors could be held rigidly in place in the subassembly comprising the slider and the bridging contactors.

The switch constructions described provide distinct advantages from assembly and handling standpoints. As has been indicated, the designs are such that all parts snap together whereby assembly operations such as soldering, crimping, glueing, etcetera, are completely unnecessary. More significantly, the switch constructions provide top and base assemblies which remain in assembly independently of each other. Accordingly, the assembler can ship the top and bottom assemblies as separate pieces without taking any special measures for purposes of keeping the respective assemblies intact during shipping.

The utilization of the self-sustaining top and base assemblies provides distinct advantages during incorporation of the switches in a circuit. As is well-known, electrical leads are applied to the terminals of such switches by means of soldering operations, and the atmospheric conditions developed as well as the handling of the switches very often leads to contamination of switch contact surfaces. Such contamination often materially alters the electrical characteristics of the switches.

With the present invention, the independent base assemblies are first attached to a printed circuit board or otherwise included in an electrical circuit with the necessary soldering operations being carried out. At this point, solvents or other cleaning mechanisms can be utilized to remove any contamination from the contact surfaces. The top assembly can then be readily pressed into place, and the switch is immediately operable.

The terminal elements described are particularly advantageous since they are easily assembled with a base construction by simply forcing the elements sideways into association with the base. When assembled, the elements are automatically held against both horizontal and vertical displacement relative to the base. In this connection, it will be appreciated that association of the base with a top assembly 12 or 84 operates to automatically force the terminal elements into locked position. Thus, any elements which are not pushed completely "home" will be driven inwardly when the walls of the enclosure 16 are pushed into position relative to the base supporting the terminal elements. The curved lower edges of the enclosure 16 and the curved surfaces of the terminal elements facilitate this action.

The switch illustrated is of the slide switch variety wherein the bridging contactors 46 or 94 are pivoted into engagement with the contacts on one side of the fulcrums depending upon the operation of the respective sliders 20 and 88. The construction illustrated in FIGS. 1 through 6 is particularly suited for a double pole-double throw arrangement with the bridging contactors pressing against one pair of terminal elements 52 while simultaneously engaging the respective terminals 72. The details of this switch construction do not form a part of this invention. The particular characteristics of this switch are described in detail in Gaber application Ser. No. 695,937, filed on June 14, 1976, and entitled "Double Pole-Double Throw Switch".

The switch design of FIGS. 7 and 8 is particularly suited for single pole-single throw or single pole-double throw operation. The bridge conductor 94 will bridge a pair of contacts at one end of the base 102 and, a separate pair of contacts may be situated at the other end of the base. One contact at each end may be commonly connected.

It will be appreciated that various changes and modifications may be made in the above described construction which provide the characteristics of the invention without departing from the spirit thereof particularly as defined by the following claims.

That which is claimed is:

1. In a switch construction wherein opposed contacts are positioned on a base, a slider, and a bridging contactor in assembly with said slider, the slider assembly being mounted in an enclosure, the enclosure being adapted for attachment to the base for sliding movement of the slider assembly relative to the base and within the enclosure whereby the contactor shifts between a first position completing a circuit between the contacts and a second position whereat the contactor is out of engagement with at least one contact, and including a resilient means carried by the slider normally applying force to the contactor for pressing the contactor against the contacts on the base during switch operation, the improvement wherein said slider assembly includes means for holding the slider and contactor together whereby the assembly thereof remains intact when separated from the base, said holding means including ledge means defined by the slider, wings carried by said contactor, said resilient means in the assembly pressing the wings of the contactor against the ledge means when the assembly is separated from the base, and means projecting outwardly from said base for engaging the contactor when the assembly is connected to the base for thereby forcing the contactor wings out of engagement with the ledge means in opposition to said resilient means.

2. A switch construction in accordance with claim 1 wherein said contactor consists of a rocker and conductive bridging elements carried by the rocker, said wings supporting the bridging elements on the rocker.

3. A construction in accordance with claim 1 wherein said enclosure includes walls defining an interior for receiving the base, and cooperating locking means carried by the enclosure walls and by the base, and enclosure and slider assembly forming a unit which remains intact when separated from said base.

4. A construction in accordance with claim 3 including an opening defined by said enclosure, an operating button carrying said slider assembly, said button extending through said opening, means for attaching said button to said enclosure in the vicinity of said opening, said button defining a hollow interior, said resilient means comprising a spring within said interior, opposed button wall sections extending outwardly from said interior, openings defined by said wall sections, said wings being received within said openings, transverse edges defined by said openings providing said ledges, said spring pressing said wings against said transverse edges when the slider assembly is separated from the base to thereby hold the slider assembly, said button and said enclosure intact.

5. A construction in accordance with claim 4 including a spherical ball positioned between said spring and bridging contactor for transmitting the spring force to the contactor, said spring force urging the contactor against said contacts when said slider assembly is connected to said base.

6. A construction in accordance with claim 1 wherein said base defines a fulcrum member, contacts positioned on opposite sides of the fulcrum member, said bridging contactor pivoting about said fulcrum member during operation of said switch.

7. A construction in accordance with claim 6 wherein said fulcrum member is a conductor, and including terminals for including said fulcrum member in an electrical circuit with said bridging contactor.

8. In an assembled electrical device comprising at least one contact mounted on a supporting base, the improvement wherein said base defines at least one receiving slot, said contact including a body portion having a thickness substantially equal to the width of said slot whereby the contact is receivable in said slot, a recess formed in at least one of the walls defining the slot, and a protrusion formed on said body portion, said base being formed of material which is sufficiently resilient to permit forcing of the body portion into the slot whereby said protrusion is received by said recess, said contact being thereby tightly held in place by said base upon insertion in said slot, said contact including an extension of said body portion of one side thereof defining a contact surface spaced from the base surface for exposure on one side of said base, and an extension of said body portion on the other side thereof forming terminal means extending outwardly from the base surface on the opposite side of said base.

9. A device in accordance with claim 8 wherein said protrusion and recess hold said contact against displacement in a direction parallel to the direction of insertion of the contact into the slot, and wherein said contact defines at least one arm separate from said protrusion, said arm extending inwardly of said base beyond the extent of said slot for engagement with a surface of said base which extends beyond said slot, the engagement between said arm and said base locking said contact against movement of said contact relative to the base in a direction perpendicular to the direction of insertion of the contact.

10. A device in accordance with claim 9 wherein a pair of said arms are provided for straddling a portion of said base.

11. A device in accordance with claim 8 including a movable contact for engagement with the contact mounted on said supporting base, an enclosure for supporting said movable contact, the walls of said enclosure defining an area for receiving the base, contact engaging surfaces defined by said walls, assembling said enclosure with said base resulting in driving of said surfaces against said contact for thereby tending to force said contact into said slot and for thereby providing means for insuring the seating of the contact relative to the base.

12. A device in accordance with claim 8 wherein said contact surface extends outwardly from said base, at least one additional contact surface positioned in spaced relationship therewith, and a bridging contactor adapted to extend between the spaced contact surfaces.

13. A device in accordance with claim 12 wherein said additional contact surface provides a fulcrum for pivoting movement of said bridging contactor relative to said base.

14. A device in accordance with claim 8 wherein said contact surface is defined by a spring finger which is movable relative to said base in response to engagement by a movable contact element.

* * * * *